United States Patent [19]

Heintzelman et al.

[11] Patent Number: 5,030,033

[45] Date of Patent: Jul. 9, 1991

[54] MATERIAL CONTAINMENT SYSTEM

[76] Inventors: Stephen D. Heintzelman, 420 Bright Road, Findlay, Ohio 45840; C. Randolph Strauch, 934 Rogers St., Bucyrus, Ohio 44820; William E. Montooth, 8520 Township Rd., Findlay, Ohio 45480

[21] Appl. No.: 406,095

[22] Filed: Sep. 12, 1989

[51] Int. Cl.[5] ..... B65G 5/00

[52] U.S. Cl. ..... 405/128; 220/88.3; 405/52; 405/53

[58] Field of Search ..... 405/52, 53, 128, 129; 73/49.2; 220/88 B

[56] References Cited

U.S. PATENT DOCUMENTS

| | | | |
|---|---|---|---|
| 3,263,378 | 8/1966 | Dorris | 52/169.6 X |
| 3,389,829 | 6/1968 | Stanford | 220/88 B X |
| 3,596,419 | 8/1971 | Jalbert | 52/21 X |
| 3,848,765 | 11/1974 | Durkop | 73/49.2 T X |
| 3,902,356 | 9/1975 | Rupf-Bolz | 73/49.2 T |
| 4,088,193 | 5/1978 | Colgate | 220/88 B X |
| 4,464,081 | 8/1984 | Hillier et al. | 405/53 X |
| 4,638,920 | 1/1987 | Goodhues | 73/49.2 T X |

FOREIGN PATENT DOCUMENTS

| | | | |
|---|---|---|---|
| 2629369 | 6/1978 | Fed. Rep. of Germany | 73/49.2 T |
| 2520506 | 7/1983 | France | 73/49.2 T |
| 0222742 | 11/1985 | Japan | 73/49.2 T |

*Primary Examiner*—Dennis L. Taylor

*Attorney, Agent, or Firm*—Willian Brinks Olds Hofer Gilson & Lione

[57] ABSTRACT

An underground tank storage (UTS) system includes one or more storage tanks disposed within a vault. The vault may comprise a plurality of concrete sections arranged in mirror image about a horizontal mid-plane. Center sections are U-shaped, having a horizontal panel and end walls, and are arranged in upright and inverted pairs. End sections are also U-shaped with an additional wall extending between the legs of the section. These likewise are arranged in upright and inverted pairs. The vault sections are sealingly secured together with grout keys and joint tape. A suitable material resistant coating is disposed on the lower interior surface. An inert gas atmosphere is maintained within the vault. The inert gas provides an oxygen and moisture free atmosphere which improves the service life of the tanks, enhances safety and leak detection capability and inhibits the likelihood of combustion. Vapor or liquid leak sensors are provided to sense and respond to a tank leak which develops in the vault.

33 Claims, 4 Drawing Sheets

MATERIAL CONTAINMENT SYSTEM

BACKGROUND OF THE INVENTION

The invention relates generally to storage systems for liquids and hazardous waste and more particularly to a liquid and waste containment system for short term and long term storage of material which provides extended storage integrity, prompt leak sensing, and leak containment.

The safe storage of materials comprehends the extremes of a time continuum. In the case of hazardous waste such as chemicals, radioactive materials and the like, time may be measured in decades. With regard to chemicals and petroleum products used in industry and commerce, the storage time may be measured in days, weeks or months. Nonetheless, storage of these materials presents many of the same challenges. In both cases, the most serious problem that can occur is the failure of the storage vessel to provide secure storage. The failure may be slow, caused by minute pinholes or cracks, and at first appear as a small flow which gradually builds to a significant flow. Conversely, the failure may be relatively rapid, caused by spontaneous rupture of the vessel, resulting in substantially instantaneous release of its entire contents. In the first instance, the suitable response is typically detection. In the second, it is containment.

Turning to the first area, leak detection, a significant difficulty is the time delay between the onset of a leak and its detection at a location typically remote from the storage container. In large installations, it has been found impractical to provide a leak or flow sensor for every tank or container and thus, typically, the periphery of the storage area is ringed with leak sensors. The time for a leak to travel from a container to a sensor can be significant if the soil is dense or well compacted. Thus, a significant amount of material may escape before a sensor detects and responds to a leak.

In contrast, in smaller installations, a leak detector may be nonexistent or disposed at a significant distance from the container to monitor general underground conditions such as aquifer contaminants. Again, significant time and correspondingly significant amounts of material may escape before a sensor detects a leak.

In either case, a problem compounding the difficulty is often the cleanup associated with such a leak. If large regions of soil have become contaminated by particularly toxic materials, they may need to be removed and stored, further adding to the overall magnitude of the storage problem. It is thus apparent that prompt leak detection is essential to any sophisticated underground tank storage system.

The other above-referenced problem of underground storage is that of containment should the storage vessel rupture. In order to prevent uncontrolled flow of material from a ruptured vessel, it is necessary that a second containment structure fully surround the first vessel. Since it is most probable that a storage tank or vessel will rupture when fully filled, it is necessary that the containment structure define sufficient fluid retaining, i.e., fluid impervious, volume to retain all the material from the largest container. However, since it is unlikely that multiple tanks would rupture, it is generally acknowledged that this minimum volume is also the maximum required volume. If the flow of material from a ruptured tank is contained within a secondary containment structure, difficulties relating to cleanup can be greatly reduced.

Another aspect of underground storage is the life of the storage equipment itself. The longer the nominal design life of the equipment, the safer the system will be and the longer will be the mean time between failures (MTBF). For example, it is known that steel tanks and associated piping have finite life spans ranging from ten years or less in moist soil having a particularly corrosive chemical composition to thirty to forty years or more in dry sand which has no significant chemical effect on the tank. Thus, the overall integrity of the storage system can be improved by minimizing exposure of the primary storage vessel to deleterious ambient conditions.

An alternative to steel tanks are tanks fabricated of fiberglass. Fiberglass tanks include multiple layers of glass fibers, strands or belts secured together by plastic or epoxy resins. Whereas steel tanks are susceptible to deleterious ambient conditions, fiberglass storage tanks are not. The resins, however, are frequently susceptible to attack from ethanol utilized in gasoline/ethanol fuels, i.e., gasohol. It is anticipated that not only the popularity but also the ethanol concentration of such fuels will increase in the future. Since steel tanks are unaffected by ethanol, their increased use in filling stations and similar sites is likely.

The foregoing discussion suggests that improvements in the art of underground storage technology are both desirable and possible.

SUMMARY OF THE INVENTION

An underground tank storage (UTS) system includes one or more storage tanks disposed within a vault. The vault may comprise a plurality of concrete sections arranged in mirror image about a horizontal mid-plane. Center sections are generally U-shaped, having a horizontal span and perpendicular end walls, and are arranged in inverted and upright pairs. End sections are also U-shaped with an additional wall extending perpendicularly between the end walls. These sections are also arranged in inverted and upright pairs. Access to the interior of the vault is provided by sealed ports resembling manholes. The vault sections are sealingly secured together with grout keys and joint wrap. A suitable fluid and material resistant coating is applied to the interior surface.

An inert gas atmosphere is maintained within the vault by a source which may be within or external to the vault. The inert gas, such as nitrogen, is maintained at a pressure slightly above atmospheric (ambient) pressure to inhibit the influx of deleterious atmospheric constituents primarily oxygen and moisture. By replacing oxygen with an inert gas in the vault, both long term oxidation (rusting) and short term oxidation (combustion) are inhibited. This greatly extends the service life of steel storage tanks and, when storing combustible fuels such as hydrocarbon fuels, significantly reduces combustion and explosion hazards. Precautions must be taken to ensure the release of the inert gas atmosphere and replacement with oxygen bearing air before personnel enter the vault to inspect, service or work therein.

Vapor or liquid leak sensors are provided to detect and announce a leak which develops in the vault.

DESCRIPTION OF THE PREFERRED EMBODIMENT

Figure 1:
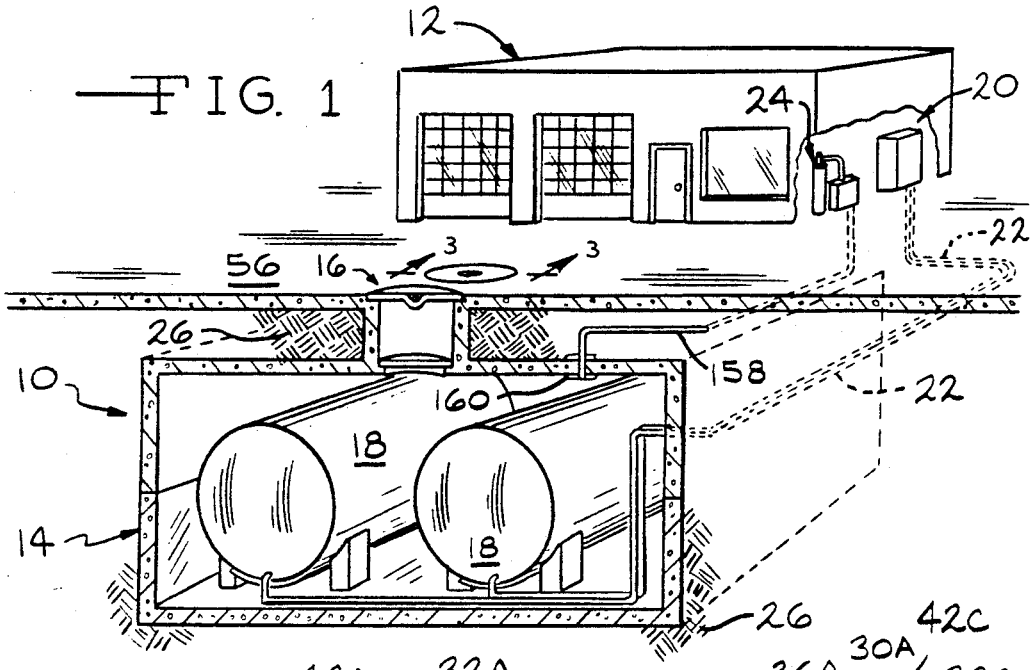
FIG. 1 is a perspective view with portions broken away of a dual tank material containment system according to the present invention.

Turning now to FIG. 1, a material containment system according to the present invention is illustrated and generally designated by the reference numeral 10. The material containment system 10 according to the present invention may, for example, be associated with a static, above ground structure 12 such as a service station. Alternatively, the static structure 12 may be a factory, terminal or other building wherein personnel receive, weigh utilize or dispense materials such as chemicals, petroleum products, diverse liquids or hazardous materials which are stored in the material containment system 10.

The material containment system 10 includes an underground vault assembly 14 having a sealed access assembly 16. The vault assembly 14 receives and surrounds one or a plurality of storage tanks 18. The storage tanks 18 are preferably fabricated of steel or material of similar strength as they are preferably freestanding within the vault assembly 14. The storage tanks 18 illustrated in FIG. 1 are presented by way of example and not by way of limitation. It should be appreciated that other tank configurations such as those having cylindrical walls disposed vertically or smaller containment structures such as drums, barrels and other vessels are equally suitable for use with the material containment system 10. The storage tanks 18 are typically in fluid communication with pumps, valves or other control or distribution equipment 20 through conduits or pipes 22. Alternatively, the conduits or pipes 22 may not be used in which case filling, emptying or gaining access to the storage tanks 18 may be achieved by valves or access ports (both not illustrated) disposed directly on the storage tanks 18. Finally, the system 10 includes an inert gas charging assembly 24. The material containment system 10 is preferably, though not necessarily, disposed below grade and surrounded by soil 26 or sand.

Figure 2:
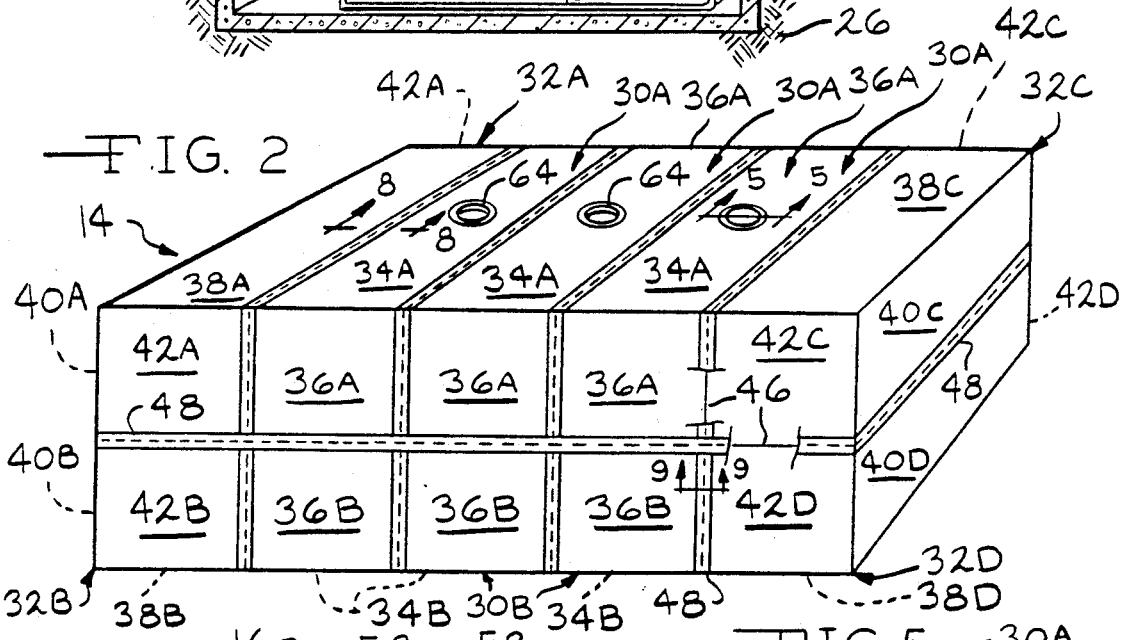
FIG. 2 is an enlarged, perspective view of a concrete storage vault for use in a material containment system according to the present invention.

Turning now to FIG. 2, the vault assembly 14 is modular in construction and utilizes a plurality of concrete upper center sections 30A and lower center sections 30B and upper end sections 32A, 32C and lower end sections 32B and 32D. The center sections 30A and 30B are substantially the same except for details regarding the sealed access assembly 16 and the horizontal grout keys set forth below. Likewise, the end sections 32A, 32B, 32C and 32D are substantially the same except for details regarding the horizontal grout keys set forth below. The sections 30A, 30B, 32A, 32B, 32C and 32D are preferably precast concrete.

The center sections 30A and 30B are U-shaped in configuration and include a horizontal span or panel 34A, a horizontal span or bottom panel 34B, respectively, and pairs of end walls 36A and 36B, respectively, disposed perpendicularly to the spans or panels 34A and 34B. Likewise, the upper end sections 32A and 32C, include horizontal top spans or panels 38A and 38C, respectively, and the lower end sections 32B and 32D include horizontal bottom spans or panels 38C and 38D, respectively. The upper end sections 32A and 32C further include vertical end panels 40A and 40B, respectively, and the lower end sections 32B and 32D further include vertical end panels 40B and 40D, respectively. Finally, the sections 32A, 32B, 32C and 32D include pairs of end walls 42A, 42B, 42C and 42D, respectively, disposed perpendicularly to the other panels of the end sections 32A, 32B, 32C and 32D.

The concrete center sections 30A and 30B and the concrete end sections 32A, 32B, 32C and 32D may be cast in any suitable dimensionally stable form. In order to maintain uniformity between sections, however, it has been found desirable to utilize rigid forms of materials such as steel and/or concrete. The concrete sections 30A, 30B, 32A, 32B, 32C and 32D and the walls and panels they constitute may also be cast in place. For example, the floor may be cast in place, then the walls and finally the upper span (roof) may be cast. Alternatively, a floor may be cast in place and inverted U-shaped sections comprising walls and an upper span may be disposed thereon. Accordingly, as used herein, the term "sections" refers to any separately cast components of the vault assembly 14 which surround the storage tanks 18 or other containers. Vault assemblies 14 having as few as two sections are thus deemed to be within the purview of this invention.

The height and length (span) of the center sections 30A, 30B and of the end sections 32A, 32B, 32C and 32D may be adjusted over a broad range of dimensions to accommodate the desired size and number of storage tanks 18. Likewise, the number of center sections 30A and 30B utilized in a given vault assembly 14 may be increased for all practical purposes without limit to accommodate the desired size and number of storage tanks.

It will thus be appreciated that a vault assembly 14 of any practical size may be assembled from six different precast sections, namely, an upper center section 30A, a lower center section 30B, an upper end section 32A, a lower end section 32B, an upper end section 32C and a lower end section 32D. In smaller installations, the center sections 30A and 30B may be eliminated and the end sections 32A, 32B, 32C and 32D may be utilized with a sealed access assembly 16 disposed in one of the upper sections 32A or 32C.

At the joints 46 formed by the intersecting edges of the sections 30A, 30B, 32A, 32B, 32C and 32D, an adhesive, tar impregnated composition tape 48 is positioned medially thereover. The composition tape 48, also known as joint wrap, preferably conforms to ASTM standard C-877. The composition tape 48 is preferably four to six inches wide and extends fully about the top, bottom, sides, ends and rear faces of the vault assembly 14 on each joint 46 as illustrated in FIG. 2. The composition tape 48 provides a secure external seal at the joint 46 between the various sections of 30A, 30B, 32A, 32B, 32C and 32D of the vault assembly 14.

Referring now to FIGS. 1, 2, 3, 4 and 5 the sealed access assemblies 16 may be disposed in one or more of the upper center sections 30A. In general, the assembly 16 includes a first circular cover 52 such as a manhole cover which is received within a correspondingly sized and configured opening 54 so that it is positioned flush with the surrounding surface such as a driveway 56 or other similar area. The first circular cover 52 includes a recessed handle 58 or other suitable grippable device for removing the cover 52. While it is not necessary that the first circular cover 52 provide an air and liquid tight seal, it is preferable that at least a water tight seal be provided so that an intermediate vertical section 60 does not accumulate water. Alternatively, a drain (not illustrated) can be provided at the lower portion of the intermediate vertical section 60 to remove water therefrom. It will be appreciated that the first circular cover 52 is utilized primarily as a cover or closure for the intermediate section 60. In installations such as those illustrated in FIG. 13 where the vault assembly 14 is either partially exposed or flush with the surface of the soil 26, the first circular cover 52 and the intermediate vertical section 60 need not, of course, be utilized.

An access aperture 64 is defined by the upper panel 34A of the upper center section 30A and extends therethrough. A circular channel 66 is disposed concentrically thereabout and is spaced from the aperture 64. The channel 66 includes a pair of vertical sidewalls 68 and a concavely curved lower surface 70 extending therebetween. A second circular cover 72 includes a handle 74 or similar grippable structure. The second circular cover 74 is a solid disk, that is, it does not include any through vents or apertures. Generally adjacent the periphery of the circular cover 72 is a circular axial projection 76 which includes a concavely curved surface 78. The curved surface 78 aligns with the curved, lower surface 70 of the circular channel 66 in the upper, center section 30A and cooperatively therewith sealingly engages an 0-ring 80. The second circular cover 72 and the 0-ring 80 provide a gas tight seal about the periphery of the aperture 64 as will be readily appreciated. Inasmuch as the sealed access assembly 16 is intended to permit access to the interior of the vault assembly 14 by personnel for inspection, maintenance or general access to the storage tanks 18, it should be understood that the components of the access assembly 16 have diameters of approximately two to three feet.

In order to minimize the number of distinct forms utilized to produce the upper, center vault sections 30A, it is anticipated that preforms for the access opening 64 will be included in each of the upper center sections 30A. The access opening preforms include aligned circular grooves 84 and 86 formed in opposite faces of the center sections 30A. The circular grooves 84 and 86 may be readily formed by positioning suitably sized annular inserts (not illustrated) in the forms for the sections 30A when cast, as will be readily appreciated. The aligned circular grooves 84 and 86 provide reduced thickness regions in the center sections 30A which facilitate removal of material to form the aperture 64. At the same time, the circular groove 66 and the concavely curved surface 70 may be formed about the periphery of the circular groove 84 by the use of suitable annular form inserts.

As illustrated in FIG. 2, the left-most two access apertures 64 have been opened whereas the material bounded by the circular grooves 84 and 86 in the right-most center section 30A has not been removed. Accordingly, the circular channel 66 and the circular groove 84 appear on the upper surface of the right-most center section 30A. It should be understood, however, that there is no necessity to form the circular channel 66 and the aligned grooves 84 and 86 in the upper center sections 30A where no aperture 64 will be formed. The elimination of such features may also be desirable, particularly if applicable design criteria discourage such standardization of center sections 30A. Conversely, the channel 66 and the circular grooves 84 and 86 may be formed in the upper end sections 32A and 32C, if desired.

Figure 6:
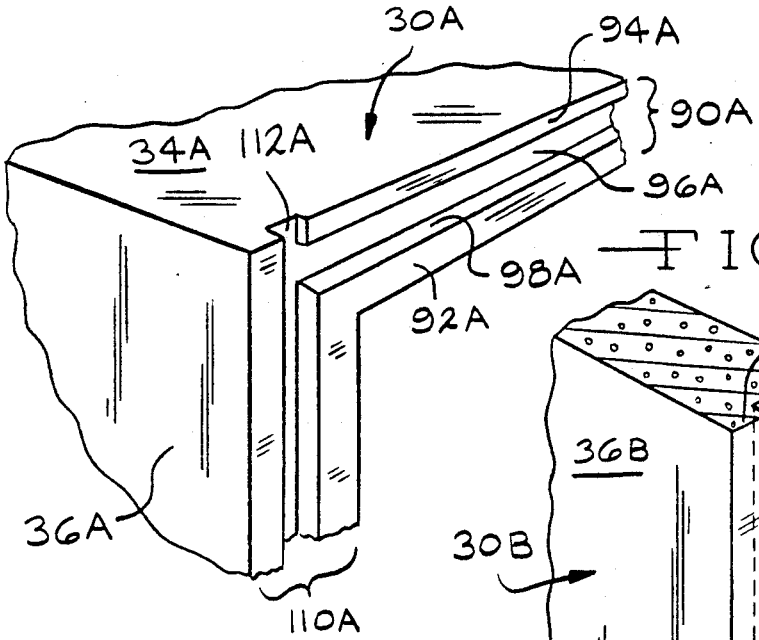
FIG. 6 a fragmentary, perspective view of an upper corner of a concrete vault section according to the present invention.
Figure 7:
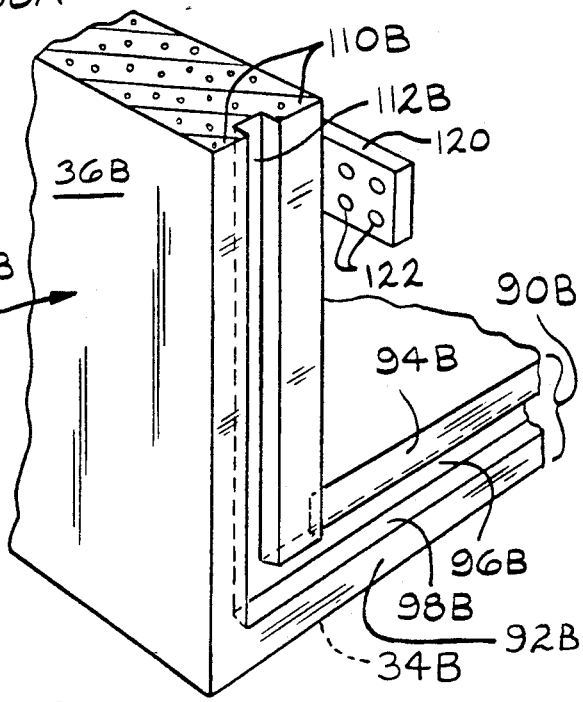
FIG. 7 is a fragmentary, perspective view of a lower corner of a concrete vault section according to the present invention.
Figure 8:
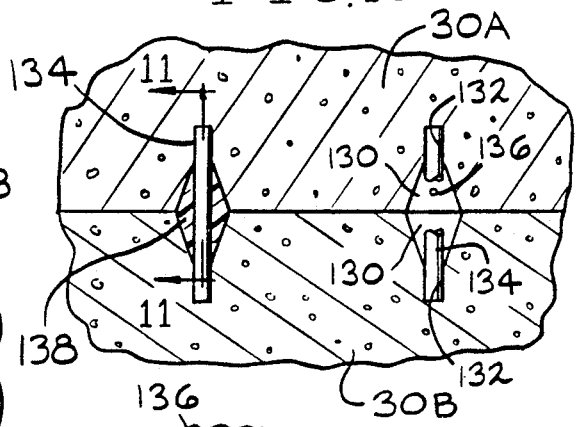
FIG. 8 is a fragmentary, sectional view of a horizontal grout key disposed in either the upper or lower panels of a concrete vault according to the present invention taken along line 8—8 of FIG. 2.

Turning now to FIGS. 6, 7, 8 and 9, the horizontally extending faces 90A of the upper center sections 30A and upper end sections, 32A and 32C define a lower, forward perpendicular edge 92A and an upper, recessed, perpendicular edge 94A which flank a groove 96A having tapering sidewalls 98A. Each horizontally extending face 90 of the upper center sections 30A and the upper end sections 32A and 32C include this configuration. Inasmuch as these features of the end faces 90A are the same on all upper center and end sections 30A, 32A and 32C, respectively, only the upper center section 30A is shown in FIG. 6. As illustrated in FIG. 8, when upper sections 30A, 32A or 32C are juxtaposed, the forward edges 92A abut and the recessed edges 94A and the channels 96A face to define a symmetrical key 102 which is filled with grout 104. The key 102 includes a narrow neck 106 which opens upwardly and thus facilitates filling of the key 102 with grout 104 when the upper center sections 30A are joined to the upper end sections 32A or 32C.

The horizontally extending faces 90B of the lower center sections 30B and the lower end sections 32B and 32D define a lower, forward perpendicular edge 92B and an upper recessed, perpendicular edge 94B which flank a groove 96B having tapering sidewalls 98B. Each horizontally extending end face 90B of the lower center sections 30B and the lower end sections 32B and 32D include this configuration. Inasmuch as these features of the end faces 90B are the same on all lower center and end sections 30B, 32B and 32D, respectively, only the lower center section 30B is shown in FIG. 7. As illustrated in FIG. 8, when lower sections 30B, 32B or 32D are juxtaposed, the forward edges 92B abut and the recessed edges 94B and channels 96B face to define a symmetrical key 102 which is filled with grout 104. The key 102 includes a narrow neck 106 which opens upwardly and thus facilitates filling of the key 102 with grout 104 when the lower center sections 30B are joined to the lower end sections 32B or 32D.

Figure 9:
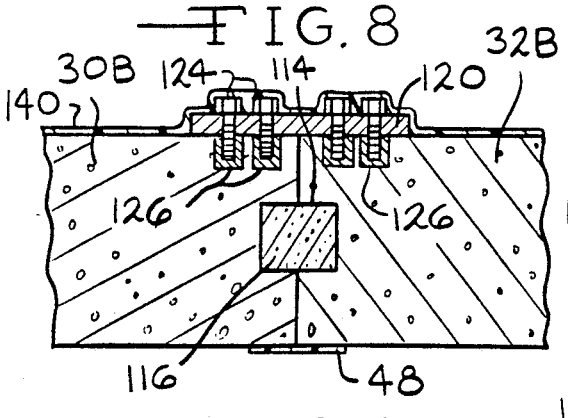
FIG. 9 is a fragmentary, sectional view of a vertical grout key disposed in the sidewalls of a concrete vault according to the present invention taken along line 9—9 of FIG. 2.

The vertical end face 110A of the upper center sections 30A as well as the upper end sections 32A and 32C (illustrated in FIG. 2) define centrally disposed channels 112A. The vertical end face 110B of the lower center section 30B as well as the lower end sections 32B and 32D (illustrated in FIG. 2) define centrally disposed channels 112B. The channels 112A extend to the upper surface of the sections 30A, 32A and 32C as shown in FIG. 6 whereas the channels 112B in the sections 30B, 32B and 32D communicates with the channel 96B and terminates at the lower wall 98B as shown in FIG. 7. When upper, center sections 30A and upper end sections 32A and 32C or lower, center sections 30B and lower end sections 32B and 32D are joined together as illustrated in FIG. 9. the channels 112A or 112B define a key 114 which is filled with grout 116 during the construction of the vault assembly 14. This is readily accomplished inasmuch as the channels 112A in the upper, center sections 30A or upper, end sections 32A and 32C extend fully to the upper surface thereof.

At each joint 46 between the lower, center sections 30B and lower end sections 32B and 32D, a metal plate 120 disposed on the inside surface of the vault assembly 14 spans the joint 46. The metal plate 120 includes a plurality of through apertures 122 which receive a like plurality of threaded fasteners 124. The threaded fasteners 124 extend into the lower sections 30B, 32B or 32D. If desired, threaded bushings 126 may be cast in place in the sections 30B, 32B and 32D to receive the threaded fasteners 124. It will be appreciated that the plates 120 and associated threaded fasteners 124 maintain the sections 30B, 32B and 32D connected thereby in tight juxtaposition.

Figure 10:
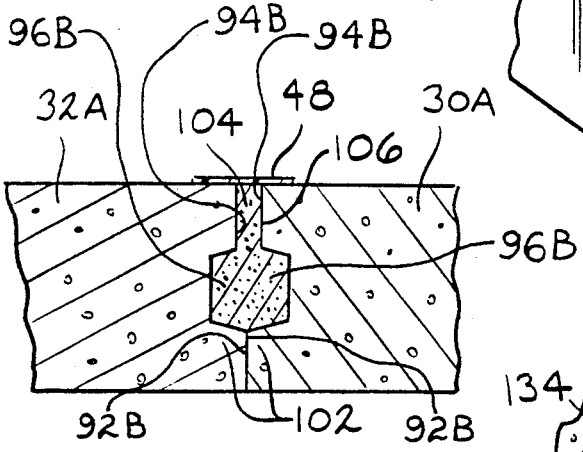
FIG. 10 is a fragmentary, sectional view of positioning pins joining the upper and lower sections of a concrete vault according to the present invention.
Figure 11:
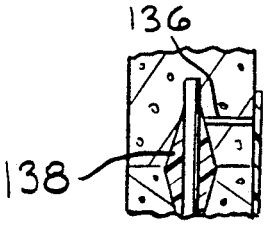
FIG. 11 is a fragmentary, sectional view of a positioning pin joining the upper and lower sections of a concrete vault according to the present invention taken along the line 11—11 of FIG. 10.

Referring now to FIGS. 10 and 11, the upper, center sections 30A, the end sections 32A and 32C, the lower, center sections 30B, and the lower, end sections 32B and 32D, may be cast with a plurality of aligned, uniformly spaced frusto-conical recesses 130 which merge into aligned, blind apertures 132. The frusto-conical recesses 130 and particularly the blind apertures 132 receive a positioning pin 134 which extends from the end of one of the blind apertures 132 to the end of the other, aligned blind aperture 132. The outside diameter of the positioning pin 134 is slightly smaller than the inside diameter of the blind apertures 132 and thus, is relatively tightly frictionally engaged within the apertures 132 and retains the upper center sections 30A or upper end sections 32A and 32C in proper position, aligned with the lower center section 30B or the lower end sections 32B and 32D, respectively. In the upper center section 30A and the upper end sections 32A and 32C, a passageway 136 extends from the frusto-conical recess 130 to the inner face of the section. The passageway 136 provides access to the interior of the frusto-conical recesses 130 in the upper sections 30A, 32A and 32C. After they have been emplaced upon the respective lower section 30B, 32B or 32D, the aligned frusto-conical recesses 130 may be filled with a suitable hardenable material 138, if desired.

Turning now to FIGS. 1, 9 and 11, it will be understood that the inner surface of the vault assembly 14, particularly the floor and walls, is covered by a liquid and chemical impervious layer or coating 140, such as an epoxy coating. The coating 140 improves the liquid retaining ability of the vault assembly 14. The coating 140 may be a product like or similar to Penseal 50 manufactured by American Metaseal, Co., Carlstadt, N.J. The particular material of the coating 140 may be selected or adjusted to ensure that it is compatible with, that is, is not attacked or deteriorated by, the material stored in the storage tanks 18. The above-recited epoxy coating 140 has been specifically selected for its broad and general service application but particular installations may require the selection of alternative coatings. For example, if the storage tanks 18 will be used for ethanol gasoline mixtures, the coating 140 should be resistant to and unaffected by these fluids. The height of the coating 140 on the inner walls of the vault assembly 14 is selected to ensure that the fluid from any ruptured storage tank 18 will be contained within the region covered by the coating 140. Generally, if the coating 140 extends up the walls one half their height, a coated region capable of retaining the liquid from any rupture will result. However, in installations with a single storage tank 18 disposed in a concrete vault assembly 14 which is only slightly larger than the tank 18, the coating 140 should extend significantly farther up the walls of the vault assembly 14 in order to ensure optimum containment of the rupture.

Figures 12, 13, 14:
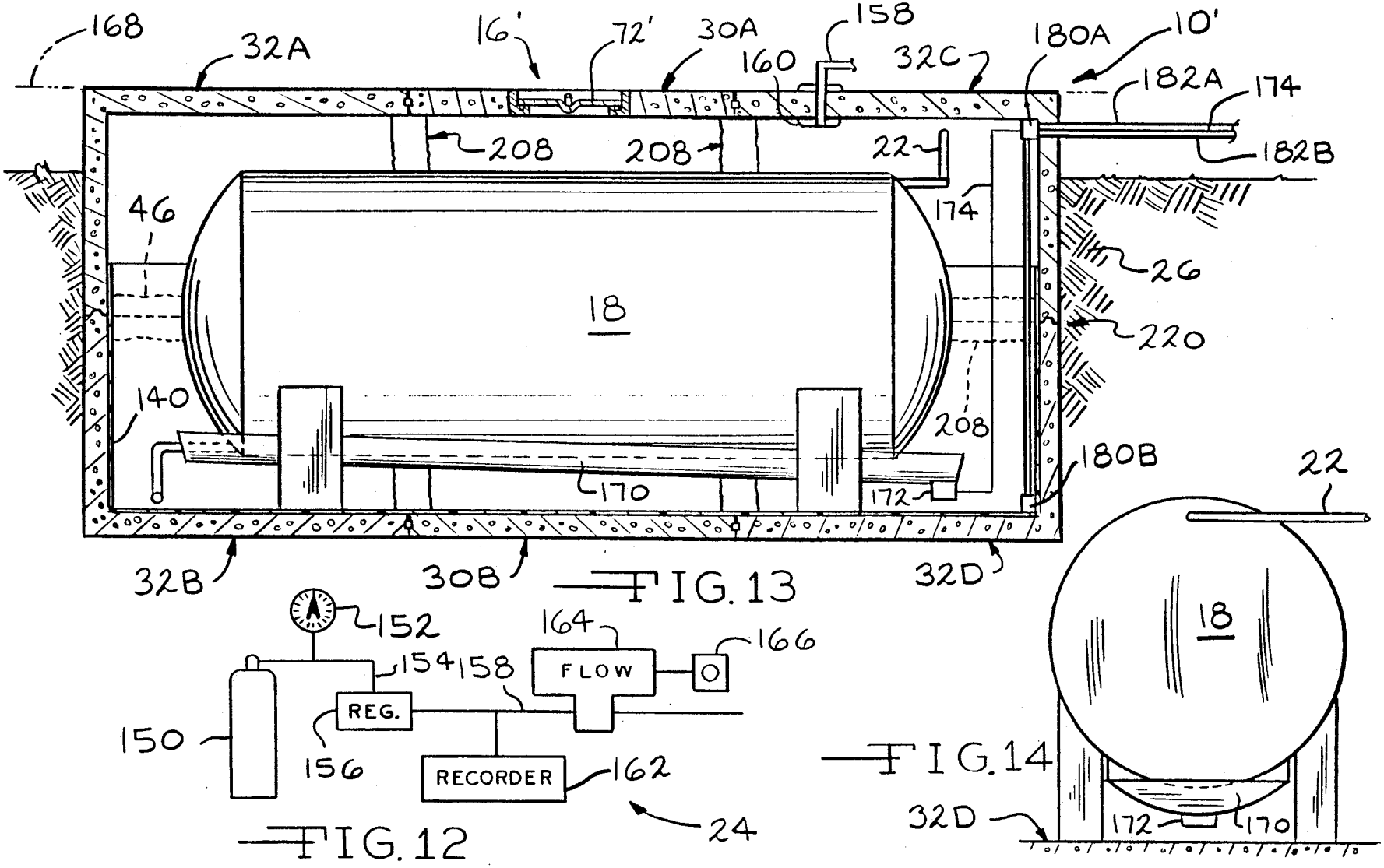
FIG. 12 is a diagrammatic view of the inert gas supply and monitoring assembly of a material containment system according to the present invention.
FIG. 13 is a side, elevational view in full section of a second embodiment material containment system according to the present invention.
FIG. 14 is an end view of a storage tank disposed in the second embodiment, material containment system according to the present invention.

Referring to FIGS. 1 and 12, the inert gas charging system 24 is illustrated. The system 24 includes a source of an inert gas, for example, nitrogen. The inert gas provides an oxygen free atmosphere within the vault assembly 14. Accordingly, other inert gases such as argon and helium may be utilized although their cost militates against such use and no particular benefit beyond the benefits derived from nitrogen is apparent. A replaceable or refillable tank 150 containing the inert gas will be the most common source of supply. The tank 150 requires replacement with a full tank or refilling, either when exhausted or, preferably on a regular basis prior to exhaustion. In order to monitor the quantity of compressed nitrogen or other inert gas remaining in the tank 150, a pressure gauge 152 in fluid communication with a supply line 154 may be utilized to monitor the pressure in the tank 150. Alternatively, the tank 150 may be disposed upon a scale or load cell (not illustrated) to constantly monitor the weight of the tank 150 and determine the need for replacement or refilling.

Nitrogen or other inert gas from the tank 150 is provided by the supply line 154 to an ambient coupled pressure regulator 156. The output of the pressure regulator 156, that is, nitrogen or other gas at a regulated pressure, is supplied to the vault assembly 14 through an output line 158 and dispersed through a suitable fitting 160. If desired, a pressure recording device 162 may be utilized to provide a record of the gas pressure delivered to the vault assembly 14 over time. A flow meter 164 may be disposed in the output line 158 to monitor the flow of gas to the vault assembly 14. Under normal circumstances, the flow will be steady and relatively small. If the seal integrity of the vault assembly 14 is lost, the flow rate will increase. When the flow meter 164 senses flow above a preselected threshold, it may activate an alarm 166 or other indicator to warn of a leak in the vault assembly 14.

The pressure regulator 156 monitors both the pressure of the gas delivered to the interior of the vault assembly 14 and the ambient (barometric) pressure. The regulator 156 maintains the delivered gas pressure to the vault assembly 14 at a maximum of about one-half p.s.i.g. (1.02 inches Hg or 14 inches of $H_2O$) and preferably in the range from 0.072 to 0.36 p.s.i.g. (0.15 to 0.74 inches Hg or 2 to 10 inches of $H_2O$). The pressurized inert gas is supplied to the interior of the vault assembly 14 to provide a positive interior pressure which inhibits the influx of air containing oxygen and moisture which would result in oxidation and deterioration of the tanks 18 and other components of the material containment system 10. The inert gas within the vault assembly 14 also minimizes the likelihood of combustion or explosion of the stored material therein as will be readily appreciated.

Clearly, it is desirable that the pressure within the vault assembly 14 be only high enough to inhibit influx of oxygen, moisture, and other contaminants and not so great as to significantly accelerate the flow of liquid or vapors from the interior of the vault assembly 14 to its exterior or utilize excessive quantities of the inert gas. It is anticipated, accordingly, that the pressure of the inert gas maintained within the vault assembly 14 may be adjusted over a wide range, that is, even beyond the pressure limits stated above in certain applications. The purpose of the pressurization, of course, is to inhibit influx of oxygen, moisture and other substances deleterious to the life of the storage tanks 18 and other components of the system 10. By excluding oxygen, not only is long term oxidation, i.e., rusting, of the steel storage tanks 18 minimized or eliminated but short term oxidation, i.e., combustion, is also inhibited. The reduced risk of combustion in a material containment system 10 utilized for the storage of, for example, hydrocarbon fuels, is a significant benefit of the instant invention. Of course, precautions must be taken to ensure the release of the inert gas atmosphere and replacement with oxygen bearing air before personnel enter the vault assembly 14 to inspect, service or work therein. Alternatively, personnel may be equipped with individual air or oxygen supply equipment.

In certain applications, the pressure within the vault assembly 14 may even be maintained at atmospheric pressure (0 p.s.i.g.) if the purity of the inert gas can be maintained simply by the addition of inert gas in a well sealed vault assembly 14. It should also be understood that the source of inert gas such as the tank 150, the pressure regulator 156 and associated components may be placed within the vault assembly 14, if desired.

Figure 3:
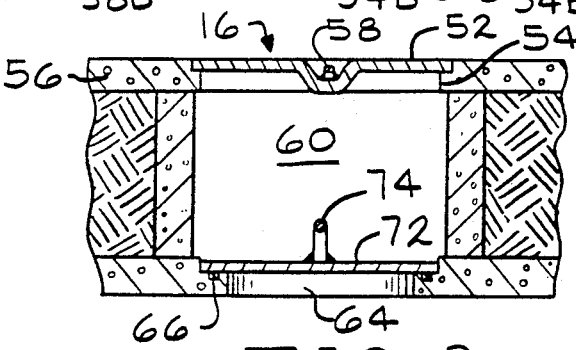
FIG. 3 is a fragmentary, sectional view of an access port and cover of a material containment system according to the present invention taken along line 3—3 of FIG. 1.
Figure 5:
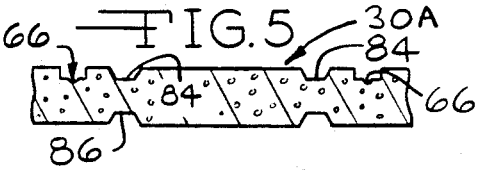
FIG. 5 is a fragmentary, sectional view of a preformed access opening in the vault of the present invention taken along line 5—5 of FIG. 2.
Figure 4:
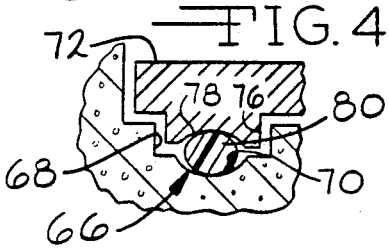
FIG. 4 is an enlarged, fragmentary, sectional view of the access port seal structure according to the present invention.

Referring now to FIGS. 13 and 14, a second embodiment of the underground material containment system 10 is illustrated and designated 10'. The vault assembly 14' is substantially the same as the vault assembly 14 discussed above. The significant difference is the disposition of the vault assembly 14' with a portion of the upper sections 30A, 32A and 32C above the ground 26. A simplified sealed access assembly 16' is utilized. As noted previously, the vertical section 60, illustrated in FIG. 3, is not required. The circular cover 72 and its associated components are described below with reference to FIG. 15. Alternatively, the vault assembly 14' may be disposed flush with the surface of the ground 26 indicated by the phantom line 168 in FIG. 13.

In the second embodiment of the material containment system 10', specific components for detecting leaks from the storage tank 18 have been incorporated. Specifically, a collection trough 170 extends from one end of the storage tank 18 to the other end. The collection trough 170 is positioned below the storage tank 18 and is inclined at a small acute angle to the horizontal. Discharge of material from the storage tank 18 will flow downwardly about the periphery of the storage tank 18 and fall into the collection trough 170. At the lower end of the collection trough 170 is positioned a liquid sensor 172. The liquid sensor 172 is in fluid communication with the material, if any, collected by the trough which flows by gravity toward the lower end of the collection trough and the liquid sensor 172. The liquid sensor 172 may be of any appropriate type depending upon the materials to be stored in the storage tank 18, the response time desired,, and other relevant factors. For example, the liquid sensor 172 may be a float type which responds to increasing height of liquid accumulation in a sump, a photo-electric type in which the collection or flow of material interrupts a light beam, or an electric conductivity type wherein the presence of liquid about two electrodes changes the inter-electrode conductivity. The signal from the sensor 172 is provided in an electrical line 174 to an indicator or warning device (not illustrated) in the static structure 12 or other attended building.

Additionally, the vault assembly 14' may include a vapor sensor 180A disposed at the ceiling of the vault assembly 14', a vapor sensor 180B disposed at the floor of the vault assembly 14' or both. The vapor sensors 180A and 180B provide the most rapid detection of the onset of a leak from the storage tank 18. The vapors sensors 180A and 180B may be like or similar to units manufactured by Bacharach Instrument Co., Pittsburgh, Pa., Gas Tech, Inc., Newark, Ca., or Intek Corp., Houston, Tex. or others. Depending upon the type of stored material, the vapor emanating therefrom and its density relative to that of the inert gas charging the interior of the vault assembly 14', only the ceiling vapor sensor 180A or the floor vapor sensor 180B need be utilized. That is, if the vapor of the material contained in the storage tank 18 is less dense of that of nitrogen or another inert gas utilized to charge the interior of the vault assembly 14', only the upper sensor 180A need be utilized. Conversely, if the vapor is heavier than the nitrogen or other inert gas, only the lower sensor 180B need be utilized. In installations where the materials stored in the tanks 18 may vary, both the upper sensor 180A and the lower sensor 180B may be utilized. The signals from the vapor sensors 180A and 180B are provided to an indicator or warning device (not illustrated) in the static structure 12 or other attended building through electrical lines 182A and 182B, respectively.

Figure 15:
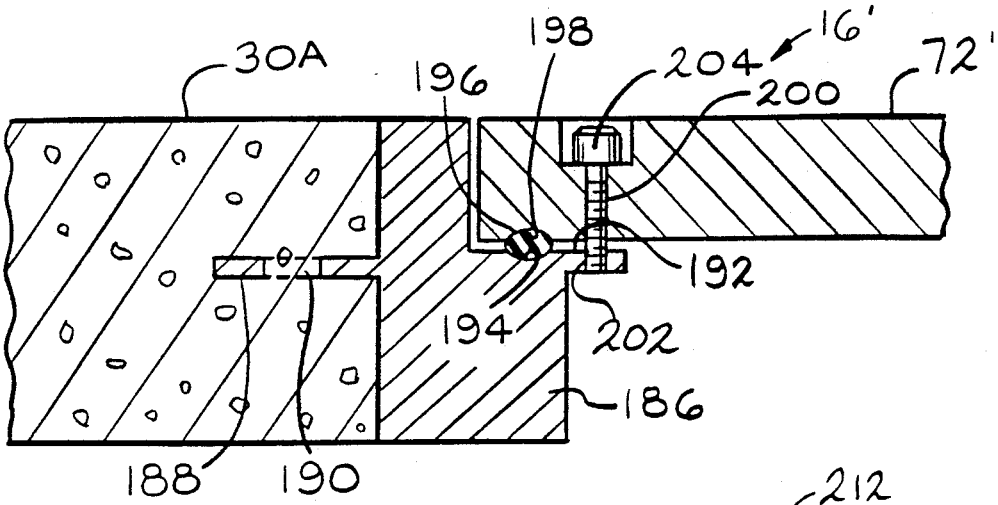
FIG. 15 is an enlarged, fragmentary, sectional view of a second embodiment access port seal structure according to the present invention.

Referring now to FIGS. 13 and 15, an alternate embodiment sealed access assembly 16' is illustrated. The alternate embodiment sealed access assembly 16' includes a circular insert 186 having a height or axial thickness which is preferably equal to the thickness of the wall of the upper center section 30A or other section in which it is disposed. The circular insert 186 includes a radially outwardly extending peripheral flange 188 which preferably defines a plurality of through apertures 190. The flange 188 and the apertures 190 ensure that the circular insert 186 will be tightly and sealingly retained within the cast concrete. That is, the interface between the exterior surface of the circular insert 186 and the cast concrete is complex and includes surfaces which will remain in close, sealed proximity.

The circular insert 186 also includes a circular shoulder 192 defining a shallow circular groove 194. The circular groove 194 receives an O-ring 196. A circular cover 72' such as a manhole cover defines a shallow circular groove 198 on its lower surface adjacent its periphery. The circular grooves 194 and 198 cooperatively receive, compress and seal against the 0-ring 196 thereby providing a gas tight seal between the circular insert 186 and the circular cover 72'. The circular cover 72' also defines a plurality of countersunk through apertures 200 arranged in a bolt circle adjacent its periphery. The countersunk apertures 200 align with threaded aperture 202 formed in the shoulder 192. Complementarily threaded fasteners 204 extend through the countersunk apertures 200 of the circular cover 72' and into the threaded apertures 202, thereby removably securing the circular cover 72' to the circular insert 186 and the vault assembly 14' as will be readily appreciated. Preferably, the circular insert 186 and circular cover 72' are fabricated of the same material such as cast iron whereas the threaded fasteners 204 are fabricated of a corrosion resistant material such as brass, stainless steel or a similar material.

Figure 16:
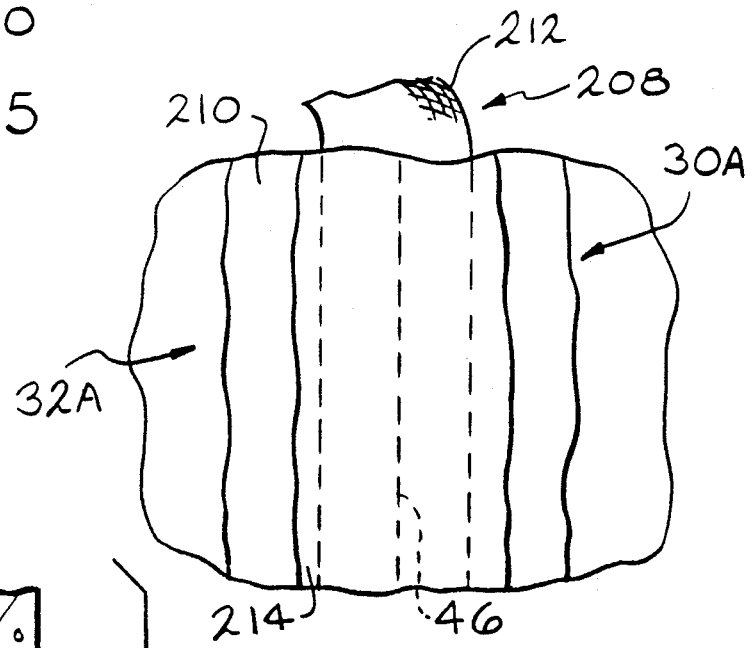
FIG. 16 is a fragmentary, side elevational view of a second seal structure for the inner surfaces of the vertical joints of a concrete vault according to the present invention.

Referring now to FIGS. 13 and 16, the construction of an interior seal 208 which may be disposed on each of the joints 46 between the precast concrete sections 30A, 30B, 32A, 32B, 32C and 32D as illustrated. The interior seal 208 is prepared by first applying a layer of epoxy resin 210 to a width of about 6 to 8 inches centered on the joint 46. A woven fiberglass or similar fabric tape 212 is then applied to the epoxy resin 210. The interior seal 208 also includes a second layer of epoxy resin 214 which is preferably the same composition as the epoxy resin 210 which is applied over the fabric tape 212 and the first layer of epoxy resin 210. The second layer of epoxy resin 214 extends slightly beyond the edges of the fabric tape 212. The interior seal 208 provides a section-to-section seal with excellent air tight and moisture tight characteristics.

Figure 17:
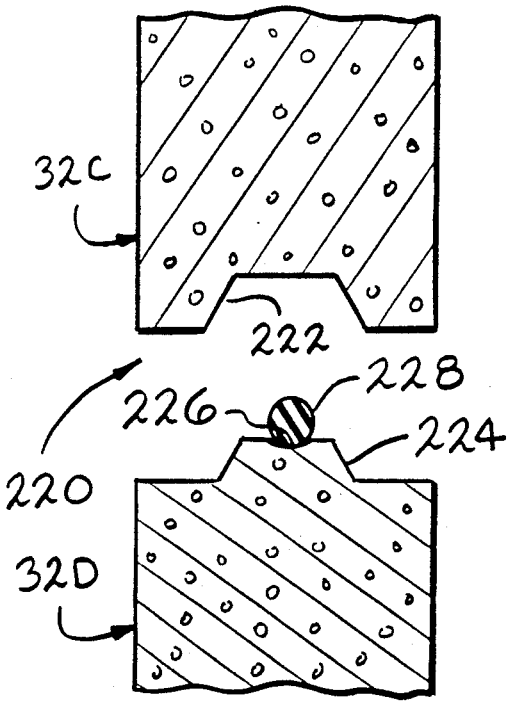
FIG. 17 is an enlarged, fragmentary, sectional view of a second embodiment horizontal joint between the upper and lower vault sections according to the present invention, in preassembly configuration.

Referring now to FIGS. 13 and 17, an alternate horizontal seal assembly 220 is illustrated. At the lower marginal edge of each of the upper center sections 30A and upper corner sections 32A and 32C is disposed a trapezoidal channel 222. On the upper marginal edge of a lower center sections 30B and lower, corner sections 32B and 32D is disposed a trapezoidal projection 224. The overall shapes and angles of the trapezoidal groove 222 and trapezoidal projection 224 are complementary. The width of the trapezoidal groove 222 at the bottom edge of the upper section 32C illustrated, is preferably about one half inch wider than the width of the trapezoidal projection adjacent the upper edge of the lower section 32D illustrated. Similarly, the height of the trapezoidal projection 224 is preferably about one quarter inch less than the depth of the trapezoidal groove 222 in the upper section 32C. Along the upper, horizontal surface of the trapezoidal projection 224 is a shallow arcuate channel 226. In preassembly configuration as illustrated in FIG. 17, the shallow arcuate channel 226 receives and positions an elastomeric seal 228. The seal 228 may be a preformed bead of butyl rubber joint seal or similar material which significantly deforms when the upper and lower concrete sections are assembled. The seal 228 is preferably between about one half and three-quarter inches in diameter and is in the form of a continuous bead which extends around the full horizontal seal between the upper and lower sections of the concrete vault assembly 14'. When the sections 32C and 32D, for example, are assembled, the elastomeric seal 228 seals the region between the trapezoidal groove 222 and the trapezoidal projection 224.

The first and second embodiments 10 and 10' of the material containment system disclose various distinct components such as the seal assemblies 16 and 16', the fluid sensor 172, the vapor sensors 180A and 180B, the recesses 130, the seal assemblies 208 and 220, and others. It should be understood that the present invention anticipates and comprehends the use of these components, and the others disclosed herein, in various combinations to respond to diverse storage, containment and leak detection parameters. Thus, for example, while the vapor sensors 180A and 180B are illustrated and described with reference to the second embodiment containment system 10', they are equally suitable and appropriate for use in the first embodiment system 10.

The foregoing is the best mode devised by the inventors for practicing this invention. It is apparent, however, that structures incorporating variations and modifications will be obvious to one skilled in the art of underground storage structures. Inasmuch as the foregoing disclosure is intended to enable one skilled in the pertinent art to practice the invention, it should not be construed to be limited thereby but should be construed to include such aforementioned obvious variations and be limited only by the spirit and scope of the following claims.

We claim:

1. A material containment system comprising, in combination, a vault defining a substantially gas impervious interior volume, said vault comprising a plurality of sections in juxtaposition, said sections defining joints therebetween, means for maintaining said vault sections in juxtaposition, means for providing a substantially gas impervious seal at said joints of said sections, storage means disposed within said vault for receiving a quantity of a material, at least one access means for providing access to the interior of said vault, said access means including seal means for providing a substantially gas impervious seal between said access means and said vault, and means for providing inert gas to said interior of said vault.

2. The material containment system of claim 1 wherein said plurality of sections include a first plurality of sections in a first, upright position and a second plurality of sections in a second, inverted position, said first and said second pluralities of sections abutting at a horizontal joint.

3. The material containment system of claim 1 wherein said access means includes an opening in one of said sections, a cover for sealing said opening and a seal disposed between said cover and said one of said sections.

4. The material containment system of claim 1 wherein said means for maintaining said vault sections in juxtaposition includes grooves disposed in abutting edges of said sections, said grooves defining a key and grout disposed in said key.

5. The material containment system of claim 1 wherein said means for maintaining said vault sections in juxtaposition includes a plurality of plates extending between adjacent said sections and plurality of fasteners for securing said plates to said abutting sections.

6. The material containment system of claim 1 wherein said storage means further includes a leak collector disposed beneath said storage means and a leak detector operably coupled to said leak collector.

7. The material containment system of claim 1 further including pipe means for providing and withdrawing material from said storage means.

8. The material containment system of claim 1 wherein said inert gas providing means includes an atmospheric pressure sensitive regulator and said inert gas is nitrogen.

9. The material containment system of claim 1 further including a vapor sensor disposed within said interior volume of said vault.

10. A material containment system comprising, in combination, a substantially gas impervious concrete vault including at least two sections, said sections abutting along joints, means for providing a substantially gas and liquid impervious seal at said joints;

storage means disposed within said vault for receiving a quantity of material, inert gas charging means for providing an inert gas atmosphere within said vault at a pressure at least equal to atmospheric pressure, and means for providing access to the interior of said vault including gas impervious seal means for sealing said access means.

11. The material containment system of claim 10 wherein said storage means defines at least one storage tank, a leak collector disposed beneath said tank and a leak detector operable communicating with said collector.

12. The material containment system of claim 10 further including at least one vapor sensor disposed adjacent the floor of said vault.

13. The material containment system of claim 10 further including at least one vapor sensor disposed adjacent the ceiling of said vault.

14. The material containment system of claim 10 wherein said inert gas charging means includes an atmospheric pressure sensitive regulator and said inert gas is nitrogen.

15. The material containment system of claim 10 further including a fluid impervious coating on the inside surface of said sections.

16. A material containment system comprising, in combination, a vault defining an interior, said vault comprising at least two juxtaposed sections, said juxtaposed sections mating along opposed complementary joints, means for maintaining said juxtaposed sections in juxtaposition, means for providing a substantially gas impervious seal at said joints of said sections, means for providing access to said interior of said vault, said access means including a opening in said vault, a gas impervious cover for said opening and seal means for providing a gas tight seal between said opening and said cover, storage means disposed within said interior for receiving and storing a quantity of material, inert gas charging means in communication with said interior of said vault for maintaining said interior substantially free of oxygen, and leak detection means for detecting the egree of material from said storage means.

17. The material containment system of claim 16 further including grout filled keys and plates having fasteners for securement to said juxtaposed sections.

18. The material containment system of claim 16 wherein said inert gas charging means includes a regulator for maintaining said interior of said vault at a pressure less than one-half (0.5) p.s.i. above atmospheric pressure.

19. The material containment system of claim 16 wherein said juxtaposed sections include at least one section in a first, upright position and at least one section in a second, inverted position, said first and said second sections abutting at a horizontal joint.

20. The material containment system of claim 16 wherein said section in said first position includes a groove about its lower edge and said section in said second position includes a projection about its upper edge and a deformable seal disposed between said groove and said projection.

21. The material containment system of claim 16 wherein said seal providing means includes sealing tape disposed across said joints between said juxtaposed sections.

22. The material containment system of claim 16 wherein said means extending across said joints includes a plurality of positioning pins received within complementarily sized blind apertures disposed in aligned pairs in said juxtaposed sections.

23. The material containment system of claim 16 wherein said inert gas charging means includes a flowmeter for measuring the rate of flow of said inert gas into said vault.

24. The material containment system of claim 16 further including a fluid impervious coating on the inside surface of said sections.

25. The material containment system of claim 16 further including a seal on said joints in said interior, said seal including a first layer of a coating material, a fabric layer and a second layer of a coating material.

26. A material containment system comprising, in combination, a substantially gas impervious vault defining an interior volume, storage means disposed in said interior volume for receiving a quantity of material, inert gas charging means for providing an inert gas atmosphere in said interior volume at a pressure at least equal to atmospheric pressure, means for providing access to said interior volume of said vault; and seal means operably disposed between said vault and said access providing means for providing a gas impervious seal therebetween.

27. The material containment system of claim 26 wherein said inert gas charging means includes an atmospheric pressure sensitive regulator and said inert gas is nitrogen.

28. The material containment system of claim 26 wherein said inert gas is nitrogen.

29. The material containment system of claim 26 further including a vapor sensor disposed within said vault.

30. The material containment system of claim 26 wherein said vault is concrete.

31. The material containment system of claim 26 wherein said vault includes at least two concrete sections and means for providing a substantially fluid impervious seal between said sections.

32. The material containment system of claim 26 further including a fluid impervious coating on the inside of said vault.

33. The material containment system of claim 26 further including a leak collector disposed beneath said storage means and a leak detector operably coupled to said leak collector.

* * * * *